United States Patent [19]

Kellow et al.

[11] 3,946,142

[45] Mar. 23, 1976

[54] COOLING OF POWER CABLES UTILIZING AN OPEN CYCLE COOLING SYSTEM

[76] Inventors: Mazin Kellow, 325 Joliette St., Apt. 309, Longueuil J4H 2G6, Quebec; James VanSant, 18 Langevin St., Chambly, Quebec J3L 2G2; Jacques Bonneville, 2050 Bedford St., St-Bruno, Quebec, J3V 4A8, all of Canada

[22] Filed: Sept. 30, 1974

[21] Appl. No.: 510,658

[52] U.S. Cl. ..... 174/15 C; 165/105

[51] Int. Cl.[2] ..... H01B 7/34

[58] Field of Search .... 174/15 R, 15 C, 16 R, 16 B, 174/11 R; 62/316, 260; 165/45, 105

[56] References Cited

UNITED STATES PATENTS

| | | | |
|---|---|---|---|
| 1,754,314 | 4/1930 | Gay | 174/15 C |
| 1,881,510 | 10/1932 | Greenwood | 174/11 R |
| 2,643,282 | 6/1953 | Greene | 174/15 R |
| 2,759,987 | 8/1956 | Narbutovskih | 174/15 R |
| 3,024,298 | 3/1962 | Goltsos et al. | 174/15 R |
| 3,362,186 | 1/1968 | Patterson | 62/316 |
| 3,406,245 | 10/1968 | Watkins | 174/15 C |
| 3,609,206 | 9/1971 | McConnell | 174/15 C |
| 3,656,545 | 4/1972 | Van Loo | 62/316 X |
| 3,684,816 | 8/1972 | Reighter | 174/15 C |

FOREIGN PATENTS OR APPLICATIONS

| | | | |
|---|---|---|---|
| 594,242 | 5/1959 | Italy | 62/316 |
| 1,224,741 | 3/1971 | United Kingdom | 174/15 C |
| 4,624,831 | 6/1968 | Japan | 174/15 C |

*Primary Examiner*—Arthur T. Grimley
*Attorney, Agent, or Firm*—Raymond A. Robic; Peter G. Mack; Arthur Schwartz

[57] ABSTRACT

An apparatus for cooling underground power cables situated in a tubular cable enclosure. Cooling of underground power cables is presently effected by the circulation of water or oil through pipes within which the cables are situated. The oil or water is then circulated through air or water-cooled heat exchangers which are uniformly spaced along the transmission line. However, a substantial flow of liquid is required to extract a useful quantity of heat, and extensive equipment is necessary to effect this flow of liquid. The subject invention proposes a relatively inexpensive and more efficient apparatus to cool underground cables. The apparatus comprises an enclosed chamber adapted to enclose a portion of a length of underground power cables. A liquid supply inlet is provided to the enclosed chamber, as well as an evaporated liquid outlet from the enclosed chamber. Means are provided to distribute liquid entering the enclosed chamber through the inlet within the enclosed chamber whereby evaporation of the liquid by heat generated within the underground power cables effects the cooling thereof. Means are also provided to initiate removal of evaporated liquid through the evaporated liquid outlet. The process according to the subject invention comprises the supplying of liquid along a length of an enclosed chamber extending along a portion of a length of the power cables, such that the liquid is distributed within the enclosed chamber. A flow of pressurized air is directed along the length of the enclosed chamber to assist the evaporation process of the liquid and to carry evaporated liquid away from the power cables. The pressurized air carrying the evaporated liquid is then removed from the enclosed chamber.

6 Claims, 6 Drawing Figures

Fig. 3
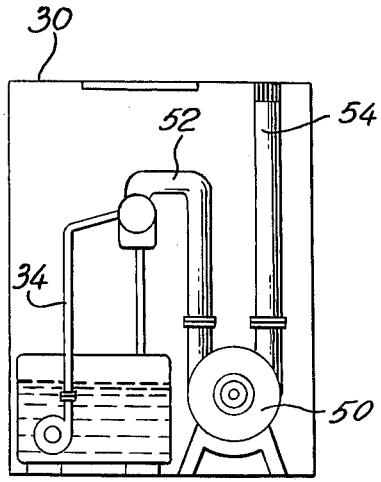
Fig. 4
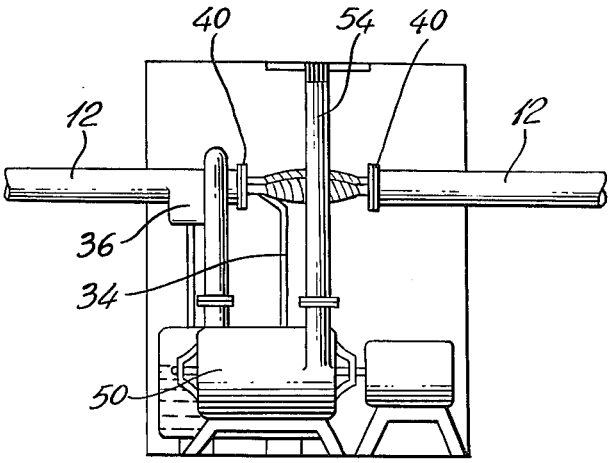
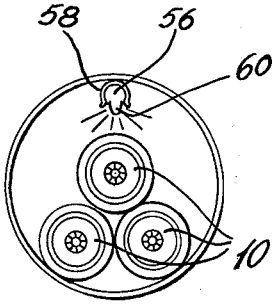
Fig. 6
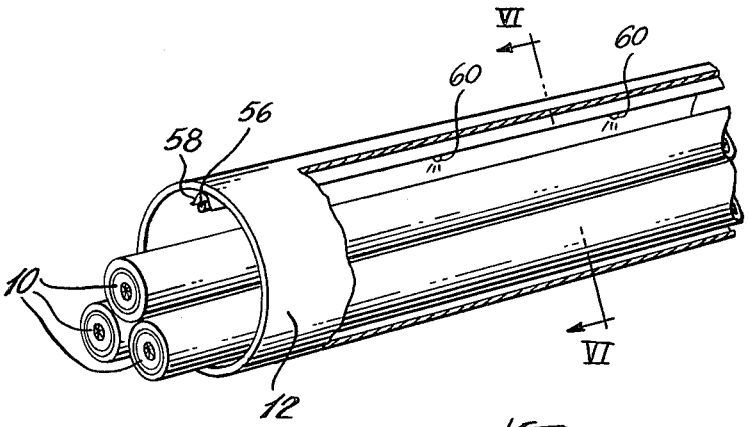
Fig. 5

COOLING OF POWER CABLES UTILIZING AN OPEN CYCLE COOLING SYSTEM

This invention relates generally to the cooling of underground power cables, and more particularly, to an apparatus and method for effecting the cooling of the power cables by inducing the evaporation of a liquid within an enclosed chamber in which portions of lengths of the power cables are situated, and by removing the vapour which is generated therein.

In underground power cables, the electrical power transmission capability is limited by the maximum operating temperature of the cable. The temperature of the cable is directly related to the amount of heat generated by the cable and the ability of its surrounding to dissipate this heat. Regardless of the method of installation of the power cable, the surrounding soil has conventionally been relied upon for the dissipation of the heat energy generated by the power cable. However, the low thermal conductivity of the soil and the variation in conductivity with locale, weather conditions and moisture content of the soil generally require that a high safety factor be utilized in relation to the current ratings of underground power cables. Higher current ratings have been achieved by the use of special backfill materials having improved thermal conductivity and moisture retention. Nevertheless, even with the use of such materials, the heat dissipation capacity of the soil has almost reached its practical limit while demands persist for underground power cables with increasing current ratings.

It is known that underground power cables can be cooled by the circulation of water or oil through pipes either buried adjacent to the length of the cables or through large diameter pipes within which the cables are situated. The oil or water is then circulated through air or water-cooled heat exchangers which are uniformly spaced along the transmission line.

In order to overcome the drawbacks inherent in known systems of cooling underground power cables, the subject invention utilizes the evaporation of a liquid within an enclosed chamber in which a portion of a length of the power cables is situated. By maintaining liquid within the enclosed chamber, heat generated within the cables induces evaporation of the liquid, the resulting evaporated liquid being removed from the enclosed chamber.

According to the subject invention, the apparatus for cooling the underground power cables comprises an enclosed chamber adapted to enclose a portion of a length of the underground power cables. A liquid supply inlet and an evaporated liquid outlet are attached to the enclosed chamber. Means are adapted to distribute liquid entering the enclosed chamber through the supply inlet within the enclosed chamber whereby evaporation of the liquid by heat generated within the underground power cables effects the cooling thereof, and means are provided which initiate removal of evaporated liquid through the evaporated liquid outlet.

Further, according to the subject invention, the process for the evaporative cooling of underground power cables comprises the supplying of liquid along a length of an enclosed chamber extending along a portion of a length of the power cables, such that the liquid is distributed within the enclosed chamber. A flow of pressurized air is directed along the length of the enclosed chamber to assist the evaporation process of the liquid and to carry evaporated liquid away from the power cables. The pressurized air carrying the evaporated liquid is then removed from the enclosed chamber.

In drawings which illustrate embodiments of the subject invention:

FIG. 3 is an end view of a diagrammatic representation of a manhole including the power cable cooling apparatus incorporating a vacuum pump;

FIG. 4 is a side view of the cooling apparatus of FIG. 3;

FIG. 5 is an enlarged perspective view of a further embodiment of the enclosed chamber portion of the apparatus according to the subject invention, partly broken away to illustrate the interior construction thereof; and FIG. 6 is a vertical cross section of the embodiment according to FIG. 5, taken along the line VI—VI.

While the preferred embodiment described below relates to individually sheated cables, the subject invention is equally applicable to other types of underground power cable installations, such as an oil filled pipe-type construction.

Figure 1:
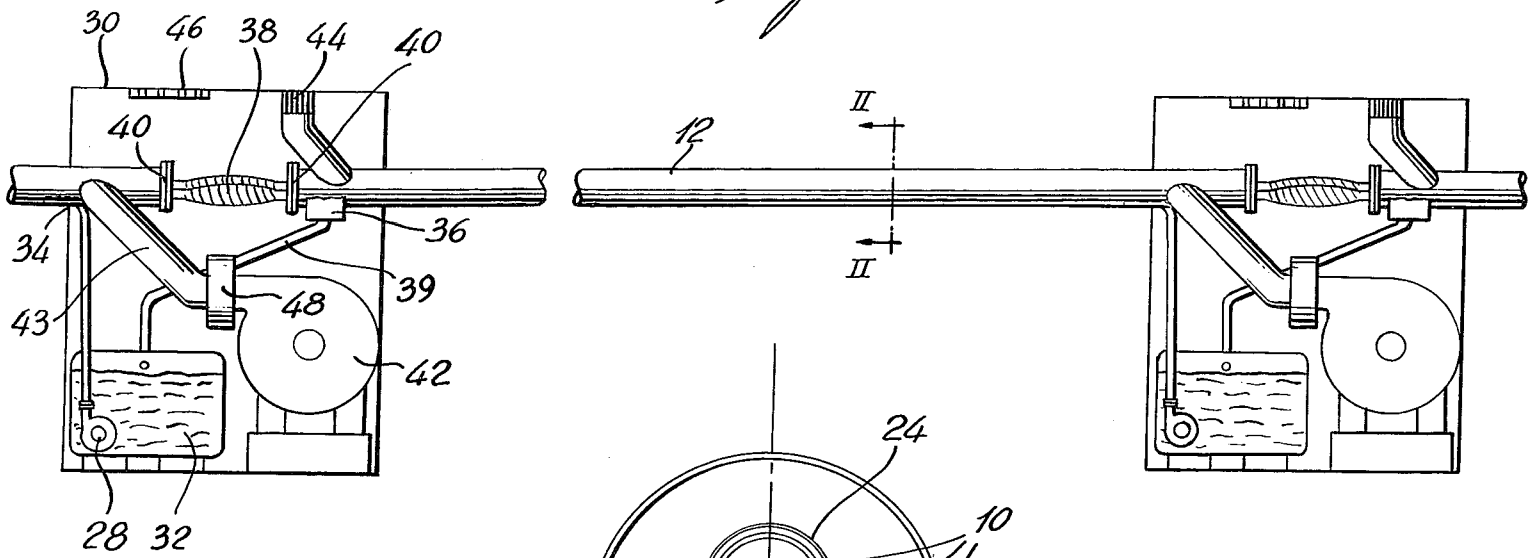
FIG. 1 is a schematic drawing of a power cable circuit incorporating a cooling apparatus according to the subject invention.
Figure 2:
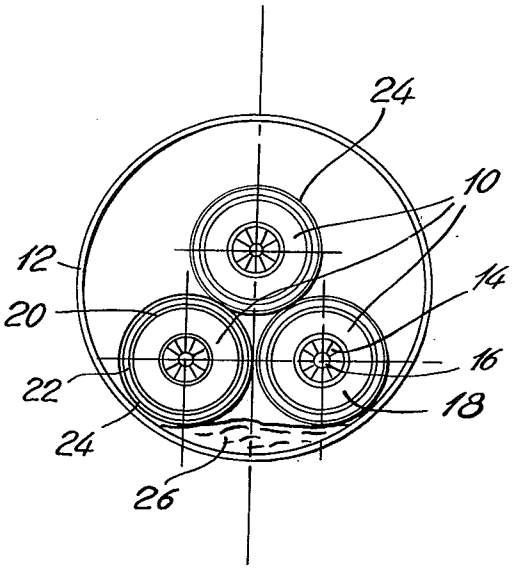
FIG. 2 is an enlarged vertical section of the enclosed chamber portion of the embodiment according to FIG. 1 taken along the line II—II.

As best illustrated in FIGS. 1 and 2, the apparatus according to the subject invention is applied to a 3-phase high-voltage transmission circuit comprising three individually sheathed cables 10 situated within an enclosed chamber 12. While three cables are shown as being located in the enclosed chamber, the apparatus according to the subject invention can be applied to any number of cables, depending on the size of the enclosed chamber 12 utilized. The cables 10 have segmented copper conductors 14, a central oil duct 16, oil impregnated paper insulation 18, a metallic sheath 20 and an extruded polyethylene sheath 22.

According to the embodiment of FIG. 2, each power cable 10 includes an outermost layer of porous material 24 which is applied to the cables during the final stages of manufacture. A skid wire may further be applied to the outer surface of layer 24. The porous layer 24 may be made up of jute, fibreglass or other materials possessing good water retentiveness while being chemically stable.

The lower portion of the enclosed chamber 12 defines a first passageway, extending along this entire length of the chamber, the first passageway containing liquid 26. The upper portion of the chamber defines a second passageway, extending along the entire length of the chamber, for carrying vapor. Since portions of the layers of porous material 24 are in contact with the liquid 26, as shown in FIG. 2, it is clear that certain of the power cables and associated porous layers intersect both the first and second passageways. The capillary action of the porous layer distributes the liquid 26 over the outer surfaces of the power cables. The liquid 26 is preferably water which has been de-ionized and chlorinated in order to avoid build-up of salts or growth of living organisms within the enclosed chamber 12 and over the outer surfaces of the cables 10. A small water pump 28, situated within a manhole 30, is used to pump the liquid 26 from a reservoir 32 within the manhole, through a liquid supply inlet 34 attached to the enclosed chamber and into the enclosed chamber 12. The liquid 26 flows along the length of the enclosed chamber 12 by gravity flow, the enclosed chamber being sloped downwardly away from the supply inlet 34 to an overflow reservoir 36 located at an opposite end of the enclosed chamber 12. A liquid outlet 39 is attached to the bottom of the overflow reservoir and leads liquid which has accumulated within the overflow reservoir 6 to a reservoir 32 within the manhole 30. The liquid 26 is constantly being evaporated within the enclosed chamber 12 at a rate dependent directly on the rate of heat generation within the cables 10 and partly on other operating conditions within the system. Water within the main reservoirs 32 may be replenished from central reservoirs located at substations by means of a pipe buried adjacent to the enclosed chamber 12 or running inside of the enclosed chamber.

Cable joints 38 between individual lengths of cables are situated within the manholes 30, the manholes being spaced approximately 400 to 600 m. apart along the circuit length. In order to simplify the present description, the cooling of cable joints and terminations has been omitted, although a similar system of cooling according to the subject invention can be adapted to these sections of the circuit. End plates 40 of the enclosed chambers 12 are located within the manholes 32 and are sealed onto the cables 10, thereby rendering the enclosed chamber 12 between the manholes relatively air tight.

Also situated within the manholes 30, according to the embodiment of FIG. 1, are blowers 42 comprising high-capacity, low-pressure fans. The blowers 42 constitute means initiating removal of cooling liquid evaporated by heat generated within the underground power cables through evaporated liquid outlets 44. Intake air for the blower 42 enters the manhole 30 by means of ports 46 within the manhole cover. A filter 48 may be located at either the intake to or the discharge from the blower 42. The filter 48 is used to remove contaminants from the air entering enclosed chamber 12, thereby maintaining reasonable cleanliness of the interior of the enclosed chamber 12, as well as the outer surfaces of the cables 10. Pressurized air discharged from the blower 42 passes through a duct 43 and enters the enclosed chamber 12, creating a turbulent air stream therein which flows along the length of the enclosed chamber 12, thereby assisting in the evaporation of liquid within the enclosed chambers and transporting the resulting evaporated liquid out of the enclosed chamber 12 through the evaporated liquid outlet 44 located within the manhole 30. The air-vapor mixture is thereby exhausted to atmosphere, thus dissipating the heat generated within the cables 10.

The pressurized air enters the enclosed chamber 12 with a low specific humidity; but quickly becomes saturated as it accumulates liquid vapor while sustaining a slight drop in temperature. As the pressurized air advances along the enclosed chamber, its temperature rises due to forced convection and the evaporation-condensation processes. This rise in temperature results in a substantial increase in the specific humidity of the air, that is, the ability of the air to contain an increased amount of vapor per unit volume thereof. As a result, the air is able to transport greater quantities of heat while sustaining a minimum rise in temperature, thus providing a suitable medium for the cooling of the power cables 10. Furthermore, heat transfer and vapor condensation occur at the inner surface of the enclosed chamber 12, the heat being dissipated through the surrounding soil which acts in its normal capacity as a cooling medium.

As best illustrated in FIGS. 3 and 4, evaporation of the liquid within the enclosed chamber 12 may be induced by maintaining a negative pressure therein. In order to provide this negative pressure, a vacuum pump 50 is utilized in place of the blower 42. The vacuum pump 50 is situated within the manhole 30 and has an inlet 52 which is connected to the enclosed chambers 12. In this embodiment, the enclosed chamber 12 includes end plates 40 which are sealed onto the cables 10 so as to provide an air-tight enclosure. In addition, the use of the vacuum pump compensates for leaks in the system. Liquid is supplied to the enclosed chamber 12 and distributed within the enclosed chamber 12 in the manner as previously outlined. The liquid supply inlet 34 and the overflow reservoir 36 may both be installed at the lower end of the downwardly sloping enclosed chamber 12, the liquid being pumped along a small tube within the enclosed chamber and being discharged at the opposite end of the enclosed chamber 12.

Vacuum pump 50 is employed to reduce the pressure within the enclosed chamber to 50 to 100 mm. of mercury absolute, whereby rapid evaporation of the liquid can be achieved. For example, when water is utilized as the liquid, the water boils at temperatures of 38° to 52°C. The generated vapor is pumped by the vacuum pump 50 and exhausted through its exhaust duct 54 to atmosphere, thus dissipating the heat generated by the cables. In addition, a certain amount of condensation takes place at the inner surface of the enclosed chamber 12 with the released heat being dissipated through the surrounding soil. When a reasonably large enclosed chamber is utilized, variations in vapor pressure along the chamber, required to induce flow of the vapor, are small. The respective vapor temperature and cable surface temperature are thus reasonably uniform along the enclosed chamber 12. The surface temperature of the cables may further be controlled by varying the pumping rate of the vacuum pump 50 and the associated pressure within the enclosed chamber 12.

As best illustrated in the embodiment of FIGS. 5 and 6, the layer of porous material may be replaced by a system utilizing a flexible tubing 56 which is supported along the inner surface of the enclosed chamber 12 by means of a cylindrical channel 58 having a slit along its length and being attached to the inner surface of the enclosed chamber 12. The channel is so constructed as to support the flexible tubing 56 therein above the power cable within the enclosed chamber 12. The flexible tubing 56 includes fog nozzles 60 extending downwardly therefrom at equal intervals along the length of the tubing. The flow of liquid within the flexible tubing is provided by a small pump within the manhole, the pump having a suction line connected to the main reservoir within the manhole 30. The nozzles 60 generate a water mist within the enclosed chamber which is carried by the flow of forced air. Cooling is achieved by evaporation of small liquid droplets entrained in the air stream. Further, evaporation of the liquid may be achieved by use of the embodiment of the invention including the vacuum pump 50.

We claim:

1. An underground power cable system comprising:

a. a plurality of elongated, closed chambers arranged sequentially in substantially end-to-end relationship;

b. a plurality of stations, one station being disposed between each pair of adjacent ends of elongated chamber pairs;

c. a reservoir in each station, each reservoir having a supply of water therein;

d. a pump in each station, said pump communicating both with said reservoir and one of said elongated chambers;

e. each elongated chamber having at least one electrical power cable passing therethrough and having a first portion defining a first passageway for liquid water, said first passageway extending along the entire length of said chamber, each chamber also having a second portion defining a passageway for water vapor, said second passageway extending along the entire length of said chamber;

f. means, comprising a layer of porous material surrounding said cable, for distributing water by drawing liquid from said first passageway by capillary action and thereby providing uniform wetting of a surface of said distributing means, said power cable and distributing means intersecting both said first and said second passageways;

g. means connected with each elongated chamber for forcibly moving water vapor from said enclosed chamber to the atmosphere;

h. whereby water drawn from said first passageway by said distributing means is evaporated into said second passageway to cool the power cable, and the water vapor thus formed is moved downstream through said elongated chamber by moving means and is heated by said cable to further increase evaporation and to cool the downstream portion of the cable.

2. An underground power cable system according to claim 1, including a liquid supply inlet adjacent one end of each enclosed chamber, each liquid supply inlet effecting communication between one enclosed chamber and the pump of the associated upstream station and a vapor outlet adjacent the other end of said enclosed chamber, said vapor outlet effecting venting of said enclosed chamber to the atmosphere, and wherein the means for forcibly moving water vapor comprises a blower connected to the end of the enclosed chamber adjacent the liquid supply inlet, the blower adapted to create a flow of turbulent air along the duct which carries evaporated liquid out of the enclosed chamber through the vapor outlet.

3. An apparatus for cooling underground power cables according to claim 2, wherein the enclosed chamber being sloped downwardly away from the liquid supply inlet in order to facilitate distribution of liquid along the length of the enclosed chamber.

4. An apparatus for cooling underground power cables according to claim 1, wherein the water is de-ionized and slightly chlorinated in order to avoid build-up of salts or growth of living organisms within the enclosed chamber and over surfaces of the power cables therein.

5. An underground power cable system according to claim 1, wherein the means for forcibly moving water vapor comprises a vacuum pump having an inlet end connected to the enclosed chamber and an outlet exhausted to atmosphere, the vacuum pump creating a low pressure region within the enclosed chamber, thereby inducing low temperature evaporation of the water, whereby heat generated by the power cables is dissipated.

6. An underground power cable system according to claim 1, including water outlet means connected between each elongated chamber and one of said reservoirs, each outlet means directing excess water supplied by the reservoir of one station to the reservoir of the next succeeding downstream station.

* * * * *